US008121516B2

(12) United States Patent
Wu et al.

(10) Patent No.: US 8,121,516 B2
(45) Date of Patent: Feb. 21, 2012

(54) PROCESSING CARTRIDGE HAVING A RETRACTABLE HANDLE

(75) Inventors: Lianjun Wu, Guangdong (CN); Geming Ding, Guangdong (CN)

(73) Assignee: Zhuhai Seine Technology Limited, Guangdong (CN)

( * ) Notice: Subject to any disclaimer, the term of this patent is extended or adjusted under 35 U.S.C. 154(b) by 391 days.

(21) Appl. No.: 12/412,568

(22) Filed: Mar. 27, 2009

(65) Prior Publication Data

US 2010/0247139 A1 Sep. 30, 2010

(51) Int. Cl.
*G03G 21/16* (2006.01)
*G03G 15/00* (2006.01)

(52) U.S. Cl. ..... 399/111; 399/107

(58) Field of Classification Search ..... 399/107, 399/111

See application file for complete search history.

(56) References Cited

U.S. PATENT DOCUMENTS

| | | | | |
|---|---|---|---|---|
| 7,088,944 | B2 * | 8/2006 | Himes | |
| 7,292,803 | B2 * | 11/2007 | Ahn et al. | 399/110 |
| 7,330,679 | B2 * | 2/2008 | Kweon | 399/111 |
| 2001/0055500 | A1 * | 12/2001 | Katakabe et al. | 399/111 |
| 2005/0260010 | A1 * | 11/2005 | Yokota | 399/111 |

* cited by examiner

*Primary Examiner* — Susan Lee

(74) *Attorney, Agent, or Firm* — Jackson IPG PLLC; Demian K. Jackson

(57) ABSTRACT

A processing cartridge includes at least a photosensitive drum, a developing roller, and a casing containing the photosensitive drum and the developing roller. The photosensitive drum is fixed to the casing to form an electrostatic latent image, and the developing roller develops the electrostatic latent image on the photosensitive drum. The processing cartridge also includes a handle, and the handle is retractably fixed to the casing, which has an extending status and a shrinking status opposite to the extending status.

4 Claims, 2 Drawing Sheets

PROCESSING CARTRIDGE HAVING A RETRACTABLE HANDLE

FIELD OF THE INVENTION

The present invention involves a processing cartridge used in an electronic imaging device such as a laser printer, a copying machine or a fax machine.

BACKGROUND OF THE INVENTION

In the existing techniques, the processing cartridge of an ordinary electronic imaging device comprises a photosensitive drum, a developing roller, and a casing containing the photosensitive drum and the developing roller. The photosensitive drum is used to receive a electrostatic latent image; the developing roller provides the developer to the photosensitive drum to develop the electrostatic latent image.

When the developer in the processing cartridge is used up, the processing cartridge needs to be replaced. For that object, an ordinary processing cartridge is provided with a handle on its casing, for the convenience of assembling and disassembling the processing cartridge easily.

However, the handle of the above mentioned processing cartridge extrudes farther than the periphery of the casing of the processing cartridge, which enlarges the dimension of the processing cartridge, and that is very uneconomical.

The existing techniques also provide another kind of processing cartridge, which is provided with a folding handle fixed to the casing of the processing cartridge by a pivot, to be capable of rotating around a pivot, so as to reduce the size of the processing cartridge; but when being assembled or disassembled, it is easy to rotate around the pivot, so it is not stable.

SUMMARY OF THE INVENTION

To solve the above mentioned problems, the present invention provides a processing cartridge; the processing cartridge comprises at least a photosensitive drum, a developing roller, a casing containing the photosensitive drum and the developing roller; the photosensitive drum is fixed on the casing to form an electrostatic latent image, and the developing roller develops the electrostatic latent image on the photosensitive drum; the processing cartridge also comprises a handle, and the handle is retractably fixed to the casing, which has an extending status and a shrinking status opposite to the extending status.

The handle is symmetrically located at the approximately center of the casing. The handle comprises at least one handle slide block, at least one handle support, at least one handle torsion spring, and at least one handle stopper; the handle support is fixed to the casing, and is connected to the casing as one body; the handle stopper and the handle torsion spring are fixed to the handle support; the handle torsion spring is fixed to the handle stopper, and is at a pretightening status, so as to make the handle stopper have a certain restoring force.

Two sides of the handle support are separately provided with slideways, and the handle slide block can slide on the slideways, so as to make the handle to form the extending status and the shrinking status opposite to the extending status.

Many bulges are formed on the handle slide block, and block grooves are formed between the bulges; the handle stopper is provided with a block tip, a push pedal, and a rotation axis; the handle torsion spring is located on the rotation axis; the block tip can be stuck into the block groove, and the length of the block tip is longer than the vertical distance from the rotation axis to the handle slide block; at this time the block tip can apply an acting force to the bulge to limit the sliding of the handle slide block; when an acting force is applied to the push pedal, the block tip exits from the block groove, so the handle slide block can slide freely.

When the handle is at the extending status, for the restoring force of the handle torsion spring, the block tip of the handle stopper is stuck into the block groove on the handle slide block; for the length of the block tip is longer than the vertical distance from the rotation axis to the handle slide block, at this time the block tip can apply an acting force to the bulge to limit the handle stopper to rotate counterclockwise, so as to make the handle slide block unable to slide downwards.

When separately applying a push force to the push pedal and the handle slide block, the block tip exits from the block groove, and at this time, under the action of the push force being applied, the handle slide block slides to the shrinking status along the slideway on the handle support.

When the processing cartridge is used, if a pull force is applied to the handle slide block, the handle slide block can slide on the slideway to the extending status.

Comparing with the existing techniques, the advantages of the present invention are that:

when the handle is at the shrinking status, the size of packaging and storing is decreased, so as to save the cost;

when the handle is at the extending status, it is convenient for the users to assemble or disassemble the processing cartridge in an electronic imaging device;

the structure is more stable and reliable than the folding handle.

DETAILED DESCRIPTION OF THE PREFERRED EMBODIMENT

The detailed components and elements described in the description are provided to roundly understand the embodiments of the present invention. So, those skilled in the art will realize to be capable of making various modifications and changes to the embodiments described here, without deviating from the scope and spirit of the present invention. To be simple, the description to known functions and structures is omitted.

Figure 1:
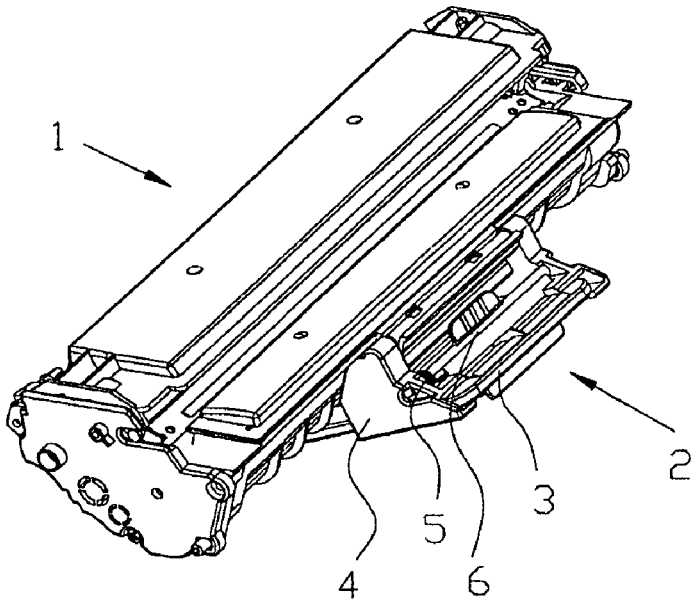
FIG. 1 is a schematic diagram of the shrinking status of the processing cartridge in accordance with an embodiment of the present invention.
Figure 2:
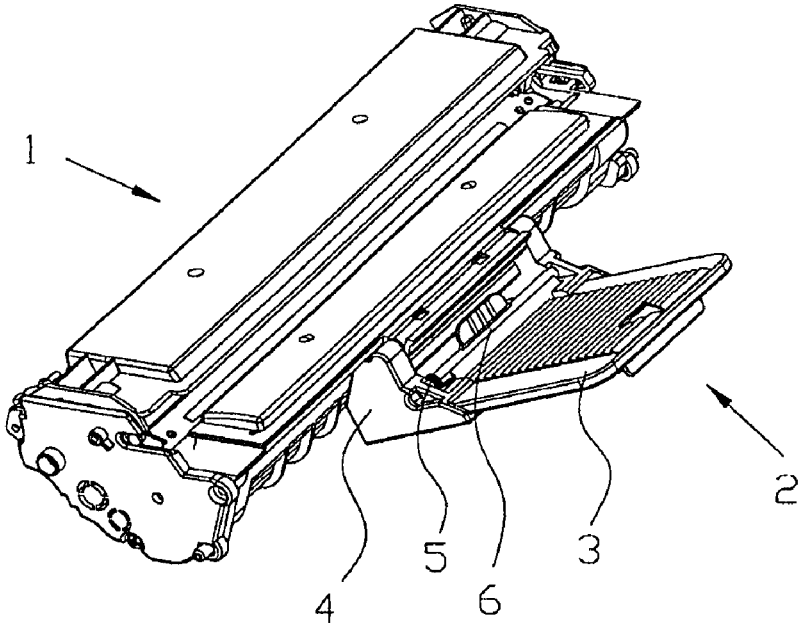
FIG. 2 is a schematic diagram of the extending status of the processing cartridge in accordance with an embodiment of the present invention.
Figure 3:
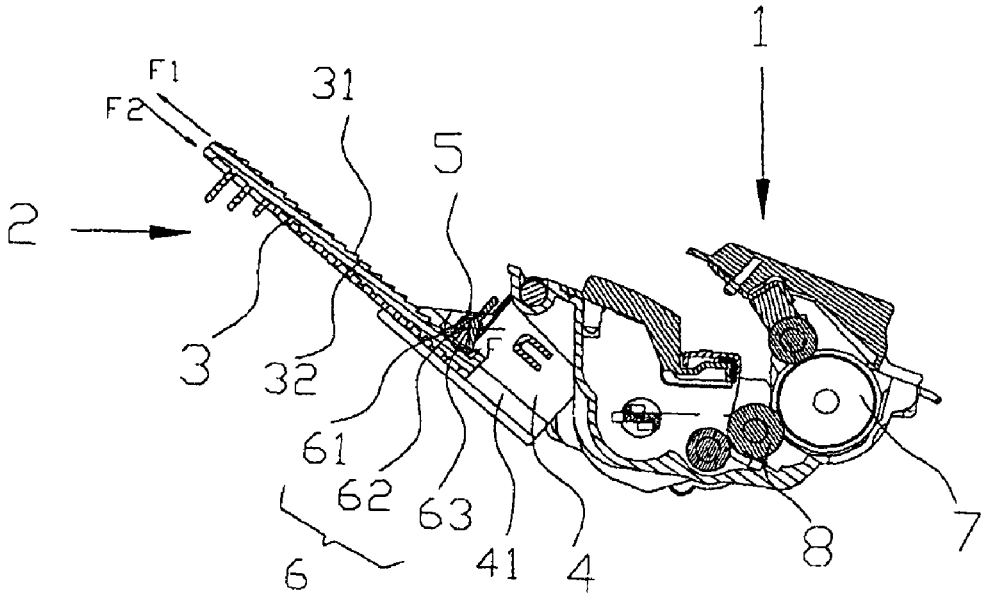
FIG. 3 is a sectional schematic diagram of the side of the processing cartridge in accordance with an embodiment of the present invention.

Referring to FIG. 1, FIG. 2 and FIG. 3, the processing cartridge comprises a photosensitive drum, a developing roller, a casing 1 containing the photosensitive drum and the developing roller, and a handle 2. The handle 2 is retractably fixed on the casing 1, and is approximately located at the center of the casing along the axial direction of the photosensitive drum, which has shrinking status and extending status. The handle 2 comprises a handle slide block 3, a handle support 4, a handle torsion spring 5, and a handle stopper 6.

The handle support 4 is fixed to the casing 1, and is connected to it as one body; the handle torsion spring 5 is fixed to the handle stopper 6, and the handle stopper 6 is fixed to the handle support 4; the handle torsion spring 5 is at a pretightening status, to make the handle stopper 6 have a certain restoring force.

Referring to FIG. 3, the two sides of the handle support 4 are separately provided with slideways 41; many bulges 31 are formed on the handle slide block 3, and block grooves 32 are formed between the bulges 31; the handle stopper 6 is provided with a block tip 61, a push pedal 62, and a rotation axis 63.

When the processing cartridge needs to change from the shrinking status to the extending status, a pull force F1 is applied to the handle slide block 3, and the handle slide block 3 can slide upward along the slideway 41; at this time, the handle stopper 6 rotates clockwise. Under the action of the restoring force applied by the handle torsion spring 5, the handle stopper 6 rotates counterclockwise to recover to the original status.

When the pull force F1 applied to the handle slide block 3 is removed, the handle stopper 6 rotates counterclockwise under the action of the restoring force of the handle torsion spring 5, to recover to the original status, and the block tip 61 of the handle stopper 6 is stuck into the block groove 32 on the handle slide block 3. When a pull force F2 is applied to the handle slide block 3, the bulges 31 of the handle slide block 3 apply a force F rotating counterclockwise to the block tip 61, to make the handle stopper 6 have the trend of rotating counterclockwise. The length of the block tip 61 of the handle stopper 6 is longer than the vertical distance from the rotation axis 63 to the handle slide block 3; at this time, a barrier force is applied to the bulge 31 on the handle slide block 3 by the block tip 61, so the handle stopper 6 can not rotate counterclockwise, and the handle slide block 3 can not slide downwards.

Figure 4:
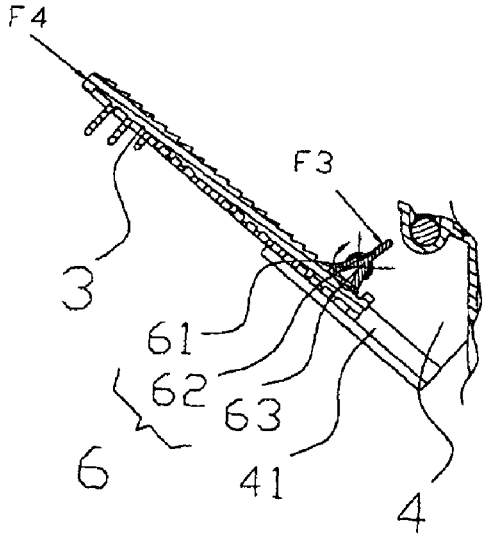
FIG. 4 is a local enlarged schematic diagram of the handle of the processing cartridge in accordance with an embodiment of the present invention.

Referring to FIG. 4, when a push force F3 is applied to the push pedal 62 of the handle stopper 6, the handle stopper 6 rotates clockwise, and the block tip 61 exits from the block groove 32; when a push force F4 is applied to the handle slide block 3, the handle slide block 3 can slide on the slideway 41 of the handle support 4, and at this time, the handle changes from the extending status to the shrinking status.

What is claimed is:

1. A processing cartridge comprising at least a photosensitive drum, a developing roller, a casing containing the photosensitive drum and the developing roller, the photosensitive drum being fixed to the casing to form an electrostatic latent image, the developing roller developing the electrostatic latent image on the photosensitive drum, and a handle, characterized in that the handle is retractably fixed to the casing, which has an extending status and a shrinking status opposite to the extending status, wherein the handle comprises at least one handle slide block, at least one handle support, at least one handle torsion spring, and at least one handle stopper; the handle support is fixed to the casing, and is connected to the casing as one body; the handle stopper and the handle torsion spring are fixed to the handle support; the handle torsion spring is fixed to the handle stopper, and is at a pretightening status, so as to make the handle stopper have a certain restoring force, wherein two sides of the handle support are separately provided with slideways, and the handle slide block can slide on the slideways, so as to make the handle to form the extending status and the shrinking status opposite to the extending status.

2. The processing cartridge of claim 1, wherein the handle is symmetrically located at the approximately center of the casing.

3. A processing cartridge comprising at least a photosensitive drum, a developing roller, a casing containing the photosensitive drum and the developing roller, the photosensitive drum being fixed to the casing to form an electrostatic latent image, the developing roller developing an electrostatic latent image on the photosensitive drum, and a handle, characterized in that the handle is retractably fixed to the casing, which has an extending status and a shrinking status opposite to the extending status, wherein the handle comprises at least one handle slide block, at least one handle support, at least one handle torsion spring, and at least one handle stopper;

the handle support is fixed to the casing, and is connected to the casing as one body; the handle stopper and the handle torsion spring are fixed to the handle support; the handle torsion spring is fixed to the handle stopper, and is at a pretightening status, so as to make the handle stopper have a certain restoring force, wherein many bulges are formed on the handle slide block, and block grooves are formed between the bulges; the handle stopper is provided with a block tip, a push pedal, and a rotation axis; the handle torsion spring is located on the rotation axis; the block tip can be stuck into the block groove, and the length of the block tip is longer than the vertical distance from the rotation axis to the handle slide block; at this time the block tip can apply an acting force to the bulge to limit the sliding of the handle slide block; when an acting force is applied to the push pedal, the block tip exits from the block groove, so the handle slide block can slide freely.

4. The processing cartridge of claim 3, wherein the handle is symmetrically located at the approximately center of the casing.

* * * * *